US008671463B2

(12) United States Patent
Hawkes

(10) Patent No.: US 8,671,463 B2
(45) Date of Patent: Mar. 18, 2014

(54) PROTECTIVE GLOVE

(75) Inventor: James Timothy Hawkes, Chelmsford (GB)

(73) Assignee: Planet Knox Limited, Cumbria (GB)

( * ) Notice: Subject to any disclaimer, the term of this patent is extended or adjusted under 35 U.S.C. 154(b) by 239 days.

(21) Appl. No.: 12/470,417

(22) Filed: May 21, 2009

(65) Prior Publication Data

US 2009/0288236 A1 Nov. 26, 2009

Related U.S. Application Data

(63) Continuation-in-part of application No. 10/544,426, filed as application No. PCT/GB2004/000442 on Feb. 5, 2004, now abandoned.

(30) Foreign Application Priority Data

Feb. 5, 2003 (GB) ..... 0302614.3

(51) Int. Cl.
*A41D 13/08* (2006.01)

(52) U.S. Cl.
USPC ..... 2/16; 2/161.6

(58) Field of Classification Search
USPC ..... 2/16, 20, 161.6
See application file for complete search history.

(56) References Cited

U.S. PATENT DOCUMENTS

| | | | | |
|---|---|---|---|---|
| 2,657,391 | A * | 11/1953 | Crandon | 2/161.8 |
| 5,121,692 | A * | 6/1992 | DiCarlo | 102/439 |
| 5,257,418 | A | 11/1993 | Jaskiewicz | |
| 5,330,249 | A * | 7/1994 | Weber et al. | 297/214 |
| 5,339,465 | A | 8/1994 | Kyewski | |
| 5,373,584 | A * | 12/1994 | Parcells, III | 2/465 |
| 5,557,803 | A | 9/1996 | Granich et al. | |
| 5,603,118 | A * | 2/1997 | Solomon | 2/20 |
| 5,815,839 | A | 10/1998 | Safford | |
| 5,829,057 | A | 11/1998 | Gunn | |
| 5,887,453 | A * | 3/1999 | Woods | 66/171 |
| 5,987,705 | A * | 11/1999 | Reynolds | 16/431 |
| 6,055,669 | A | 5/2000 | Albert | |
| 6,061,829 | A | 5/2000 | Gunn | |
| 6,154,882 | A | 12/2000 | Ullman | |
| 6,185,747 | B1 * | 2/2001 | Hughes | 2/161.6 |
| 6,200,286 | B1 * | 3/2001 | Zamani | 602/64 |
| 6,443,921 | B1 | 9/2002 | Kaplan | |
| 6,723,401 | B1 | 4/2004 | McKnight et al. | |
| 7,000,259 | B2 | 2/2006 | Matechen | |
| 2004/0010834 | A1 * | 1/2004 | Sidlo | 2/16 |

FOREIGN PATENT DOCUMENTS

| | | |
|---|---|---|
| DE | 3519633 | 12/1986 |
| DE | 19735370 | 2/1999 |
| FR | 2687549 | 8/1993 |
| JP | 1216778 | 8/1989 |

* cited by examiner

*Primary Examiner* — Katherine Moran
(74) *Attorney, Agent, or Firm* — Thorpe North & Western, LLP

(57) ABSTRACT

A glove for use on a motorcycle comprises a front and a back, the front further comprising:

a palm region, said palm region comprising an internal surface proximate a hand during use and an external surface opposite the internal surface;

a finger region; and a thumb region;

wherein said palm region comprises at least one skid protruding from said external surface; whereby on impact on a road surface the wearer slides on the surface as said skid engages the road surface.

15 Claims, 16 Drawing Sheets

PROTECTIVE GLOVE

PRIORITY CLAIM

This is a continuation-in-part of U.S. patent application Ser. No. 10/544,426 filed on Aug. 4, 2005, now abandoned, which is a national stage entry of PCT/GB04/00442 filed on Feb. 5, 2004, which claims priority to United Kingdom application Serial No. 0302614.3 filed on Feb. 5, 2003, which are hereby incorporated herein by reference in their entirety.

FIELD OF THE INVENTION

The invention relates to protective gloves used for protecting a wearer's hand and/or wrist when impacted against a surface and therefore may have particular applications in the field of motorcycles.

BACKGROUND TO THE INVENTION

By definition gloves are protective in one way or another. The boxer's gloves will for example incorporate an outer padding to protect the user's hand when punching—naturally in such circumstances the user's hand would without protection undoubtedly be damaged. Other gloves are destined to protect the user's skin as he frequently repeats a movement under a given load. One example of such gloves would be those used in weight lifting.

Many prior art gloves are designed to have enhanced gripping capacities. An example of such a glove is shown in U.S. Pat. No. 6,055,669 which presents a bowling ball glove with improved grip to allow a pitcher of a ball to impose enhanced spin to a ball. Another example of non-slip gloves is presented in Japanese document 1216778.

Motorcycle gloves are generally designed to protect the wearer during a wide variety of travel situations. One of the requirements of gloves is that they be thermally insulating which becomes particularly important in harsh weather conditions or at elevated speeds. Such gloves are also customarily equipped with a water proofing layer which may take the form of a synthesised breathable material such as GORTEX (registered trade mark). The outer coating of many motorcycle gloves are still however often made out of leather, primarily because leather offers an ideal combination of natural protective and aesthetical properties. In certain areas of the motorcyclist's gear, there is sometimes proposed the incorporation of a highly abrasion-resistant material—for example located over the kneecaps or elbows or even over the outer portion of the glove which may come into contact with the road as the user maneuvers a curve during say a race. An example of such a proposal is disclosed in GB 022627.5.

However, in this proposal the underside of the glove will primarily be designed to enhance the user's grip to facilitate difficult maneuvers to be carried out.

One of the objectives of the invention is to present a radical departure from the conventional teaching of the above discussed prior art where the underside of the glove has the sole function of improving adhesion to objects during use.

A further objective of the present invention is to provide improvements to the protective characteristics of gloves when a user is impacted or propelled onto a surface.

Prior art gloves prove generally adequate in terms of thermal insulation and in being waterproof. However, in a motorcycle fall it is typical for the user of the glove to have the reflex of outstretching his arm in the vain attempt of protecting himself from the fall. As the user with his outstretched arms impacts on the road surface his hands and wrists are submitted to forces which often result in a fracture of a metacarpal or carpal bone. Statistically, the scaphoid bone is the most likely to fracture in these instances. There are typically one thousand of such accidents per day in the United Kingdom alone, a high percentage of which results in a fractured scaphoid bone.

The scaphoid bone is crucial to the intricate function of the wrist, it is the strong mechanical link between the proximal and distal carpal rows and can be regarded as an extension of the thumb ray into the wrist. It is subjected to shearing, rotational and compression forces from several surrounding structures. Therefore, any fracture of this bone is usually complex, often requiring prolonged immobilisation. The fracture is usually accompanied by a dull, deep pain in the wrist and throughout its treatment a pain may periodically be felt which may take weeks or even months to subside.

A further objective of the present invention is therefore to offer specific protection to the bones in the hand and wrist and particularly to the scaphoid bone.

The solution to this problem presented hereafter also aims at retaining the flexibility and grip which the conventional glove user has been accustomed to.

SUMMARY OF THE INVENTION

In a first broad independent aspect the invention provides a glove for use on a motorcycle comprising a front and a back, the front further comprising:

- a palm region, said palm region comprising an internal surface proximate a hand during use and an external surface opposite the internal surface;
- a finger region; and
- a thumb region;

wherein said palm region comprises at least one skid protruding from said external surface; whereby on impact on a road surface the wearer slides on the surface as said skid engages the road surface.

In a subsidiary aspect in accordance with the first broad independent aspect, said skid is metallic.

In a further subsidiary aspect, said skid is of plastics material.

In a further subsidiary aspect, said glove incorporates a wrist crease region located above the wrist crease of a hand during use; said skid being located in a portion of said palm region between said wrist crease region and said thumb region.

In a further subsidiary aspect, said skid is located in a portion of said palm region corresponding to the scaphoid of a hand during use.

In a further subsidiary aspect, said glove incorporates a wrist crease region located above the wrist crease of a hand during use and a side region located above the side of a hand during use; said skid being located in a portion of said palm region between said wrist crease region and said side region.

In a further subsidiary aspect, said glove incorporates a wrist crease region located above the wrist crease of a hand during use and a side region located above the side of a hand during use; said glove further incorporates a first and a second skid; said first skid being located in a portion of said palm region between said wrist crease region and said thumb region and said second skid being located in a portion of said palm region between said wrist crease region and said side region.

In a further subsidiary aspect, said skid incorporates projections.

In a further subsidiary aspect, said projections are fibrous elements.

In a further subsidiary aspect, said skid is C-shaped.

In a further subsidiary aspect, the glove further comprises a wrist portion of said palm region and a fluid fillable chamber located over at least a portion of said wrist portion.

In a further subsidiary aspect, the glove further comprises a chamber located in said wrist portion and at least one adjacent chamber containing fluid; wherein said chamber in said wrist portion of the glove is primarily empty whilst riding a motorbike and on impact fluid flows from said adjacent chamber into said chamber in said wrist portion.

In a further subsidiary aspect, the glove further comprises a forearm region; a first chamber portion extending into said forearm region of said glove; a second chamber portion extending into said palm region of said glove; and a fluid in at least one of said chambers; whereby when pressure is exerted on said second chamber portion when holding the handle bars of a motorcycle said fluid is forced primarily into said first chamber portion and upon outstretching the hand, said fluid circulates from said first chamber portion to said second chamber portion.

In a further subsidiary aspect, said skid incorporates a polyethylene layer.

In a further broad independent aspect, the invention prevents a glove for protecting a wearer's hand and/or wrist when impacted against a surface, wherein the surface of the finger regions of the underside of the glove has a sufficiently high coefficient of friction to allow the gripping of objects in conventional fashion and at least one surface area located over the palm region and/or underside of the wrist region of the glove has a relatively low coefficient of friction so as to reduce any force transmitted on impact to the user's palm and/or wrist.

In a further broad independent aspect, the invention covers a glove for protecting a wearer's hand and/or wrist when impacted against a surface, wherein at least one surface area located over the palm region and/or underside of the wrist region of the glove has a sufficiently low coefficient of friction and is sufficiently cushioned as to reduce any force transmitted on impact to the user's palm and/or wrist, and the surface of the finger regions of the underside of the glove has a different coefficient of friction to allow the gripping of objects in conventional fashion.

In a further broad independent aspect, the invention presents a motorcycling glove for protecting a wearer's hand and/or wrist when impacted against a surface, wherein at least one surface of the finger regions of the underside of the glove has a sufficiently high coefficient of friction to allow the gripping of objects in conventional fashion and at least one surface area located over the palm region and/or underside of the wrist region of the glove has a sufficiently low coefficient of friction relative to the surface of impact so as to reduce any force transmitted on impact to the user's palm and/or wrist.

The above configurations have the advantage of improving the distribution of forces when a wearer's hand and/or wrist is impacted against a surface. In addition, the wearer's dexterity is not in any way hampered which allows him to freely manoeuvre objects such as the controls of a motorcycle. These configurations will also reduce the seriousness of carpal fractures and will therefore allow its wearer should he suffer a fall of having a more rapid recovery. They will also in many instances prevent any fracture occurring altogether. These configurations will also be advantageous as the force may even be diverted to the forearm of the wearer which is constituted of bones which heal in a relatively straightforward manner should they themselves fracture.

In a subsidiary aspect, the surface area having a low coefficient of friction is located over the scaphoid bone of the user's wrist.

Simply by modifying the surface area over the scaphoid bone of a user's wrist, the likely damage to this bone can be reduced or even prevented.

Advantageously, the surface area with the low coefficient of friction may comprise fibrous material, the fibres generally extending in the direction of the forearm. This would allow the glove to be particularly ergonomic while advantageously diverting the force towards the forearm.

In a further broad independent aspect, the invention covers a glove for protecting a wearer's hand and/or wrist when impacted against a surface comprising as part of its hand, wrist or forearm cover a single chamber or a series of chambers which contain fluid or are capable of containing fluid and are arranged so that any fluid flow substantially remains during conventional use of the glove within the chamber or the series of chambers and which are located in a position to protect a section of the hand, wrist, forearm by absorbing at least in part the force of the impact.

This configuration is particularly beneficial in absorbing the force resulting from the impact and thus limits the occurrence of fractures in the bones beneath the chamber and may altogether prevent such fractures occurring in many instances.

In a subsidiary aspect according to the fourth broad independent aspect, the chamber or the series of chambers cover an area corresponding essentially to the palm and/or underside of the wrist, the fingers being relatively unrestricted in movement as in a conventional glove.

This configuration offers a particularly practical solution to the incorporation of a chamber into a conventional glove.

In a further subsidiary aspect, one chamber is located in use essentially over the underside of the scaphoid bone of the user's wrist. Covering this relatively small area dramatically reduces the extent of fractures and immobilisation which are often the result of when a wearer impacts against a surface for example during a fall from a motorcycle.

In a further subsidiary aspect, any chamber in a section of the glove above the wrist crease is primarily empty during conventional use of the glove and at least one adjacent chamber projects past any such chamber over the wrist crease so that on impact fluid flows from the adjacent chamber into the chamber in the section of the glove above the wrist crease.

This configuration is particularly advantageous as it combines in a particularly non-conventional fashion ergonomic and protective properties.

In a further subsidiary aspect, a chamber with pressurised fluid and control means adapted to release said pressurised fluid on impact so that the fluid fills a protective chamber.

This aspect allows a rapid expansion of protective area without hindering the wearer's movements in conventional use.

In a further subsidiary aspect, a single chamber protrudes from the glove over essentially the palm and/or wrist and is essentially triangular when viewed in cross-section.

This configuration will allow the area of protection to rapidly spread across a wide area and facilitate the transfer of impact force from the wrist and/or palm region towards the forearm of the user. Transferring the force from the wrist to the forearm region may stress the forearm or even fracture the forearm. However, any such fracture can relatively rapidly heal as opposed to the more complex recovery which would follow the fracture of say a carpal bone.

In a further subsidiary aspect, the walls of the or each chamber are sufficiently elastic so that the or each chamber stretches on impact over the area to be protected. This configuration allows the chambers to be relatively unobtrusive whilst during impact offering improved protection.

In a further subsidiary aspect, fluid is contained in conventional use primarily in the forearm region and upon outstretching the hand, circulation of fluid from the forearm to the palm and/or wrist regions of the glove is achieved.

One of the advantages of this arrangement is that the forearm itself may be protected as well as protecting the critical palm and/or wrist regions of the glove when the hand is outstretched. Another advantage of this arrangement becomes apparent when the wearer grasps objects such as the handle bars of a motorcycle because in that mode of operation under the pressure of the grasp, the fluid is primarily retained in the forearm region so as to allow unrestricted precise grasping of objects.

In a further subsidiary aspect, the fluid circulates from each chamber to an adjacent chamber through restriction means. This allows a gradual absorption of force over the entire time of impact.

DETAILED DESCRIPTION OF THE FIGURES

Figure 1:
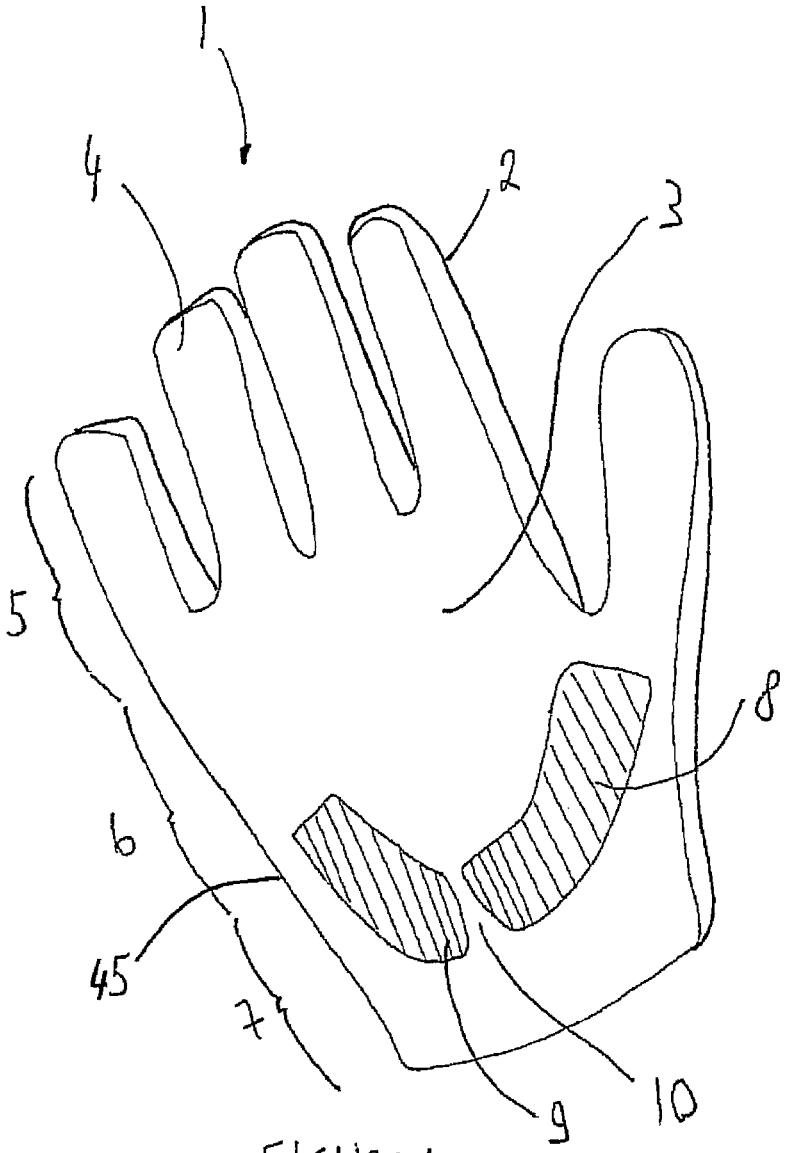
FIG. 1 shows a schematic perspective view of the underside of a right glove in accordance with a first embodiment of the present invention.

FIG. 1 shows a protective glove generally referenced 1 comprising a top side 2 (only partially visible in the drawing) and an underside 3, the glove has four separately displaceable finger and thumb covers such as that referenced 4.

The glove 1 can be approximately split into three general regions; the finger region 5, the palm region 6 and the wrist region 7. Over part of the palm region and the underside of the wrist region, there are provided two pads or skids 8 and 9. The coefficient of friction of finger region 5 may for example be equivalent to that of the leather used typically in motorcycle gear. By contrast, the coefficient of friction of pads 8 and 9 or skids 8 and 9 will be selected by the person skilled in the art to be considerably lower than at least the coefficient of friction of finger region 5 so that when the user is propelled onto a surface with his arms outstretched, the impact's force usually primarily transmitted to the palm and wrist region of the glove may be diminished and even transferred in effect towards the forearm of the wearer.

Low coefficient of friction pads 8 and 9 or skids 8 and 9 are constituted of fibre materials which are orientated in the direction of the forearm. While this construction is particularly advantageous other materials are envisaged within the scope of the present invention and may be utilised by the person skilled in the art in the design of the glove. One particularly useful material is thought to be a rigid PVC or a nylon. Other low friction materials may be a metal such as titanium, silicon, silicon copolymers, silicon elastomers, polytetrafluorethylene, homopolymers, graphites, boron, polypropylene and/or polyethylene. It is also envisaged to utilize a material which has similar low coefficient of friction as the above materials but is sufficiently bendable to allow the wearer to conventionally utilize the glove without noticeable restriction.

The area of low coefficient of friction relative to the surface of impact such as a road surface may also cover the entire underside of the glove provided that the coefficient of friction of that area with the object that the wearer grasps in conventional use such as the handle bars or other controls of a motorcycle is sufficiently high to allow the gripping of objects in conventional fashion.

The underside area of the glove may for example have a coefficient of friction with the generally plastic controls of a motorcycle of say 1, whilst a coefficient of friction with the average road surface of below 0.5.

Returning to the specific description of FIG. 1, advantageously, the typical coefficient of friction of the pad's material with the average road surface is below 0.5.

The location of the low coefficient of friction pads or skids 8 and 9 and their shape is selected to improve the ergonomics of the glove. Skids 8 and 9 generally form a C shape with a gap 10 located between pads 8 and 9 so that movements about the wrist crease are in no way impeded. Low coefficient of friction pad 8 or skid 8 extends from the base of the thumb region to the wrist crease region. No skid is provided between the skids 8 and 9. Skid 9 is located between the wrist crease region 10 and the side region 45 of the glove. The pads or skids are provided over or below the lower portion the metacarpal bones. In particularly, these are provided preferably at a lower portion of the palm only. The upper portion of the palm is of conventional leather or other similar materials. The lower portion of the palm in particular along a line corresponding to the base of the thumb receives the low coefficient of friction pads or skids.

The geometry of the low coefficient of friction pad 8 or skid 8 is designed to generally cover the scaphoid and lunate bones of the carpus of the user. The low coefficient of friction pad 8 or skid 8 covers preferably a portion of the first metacarpal (i.e. the thumb's metacarpal). It may also preferably cover a portion of the trapezium or the trapezoid bones.

Low coefficient of friction pad 9 or skid 9 is destined to cover the lower region of the last metacarpal bone which may also be subjected to fracture in a conventional glove. This pad or skid 9 may also be located over the hamate, or triquetrum bones for additional protection.

Figure 2:
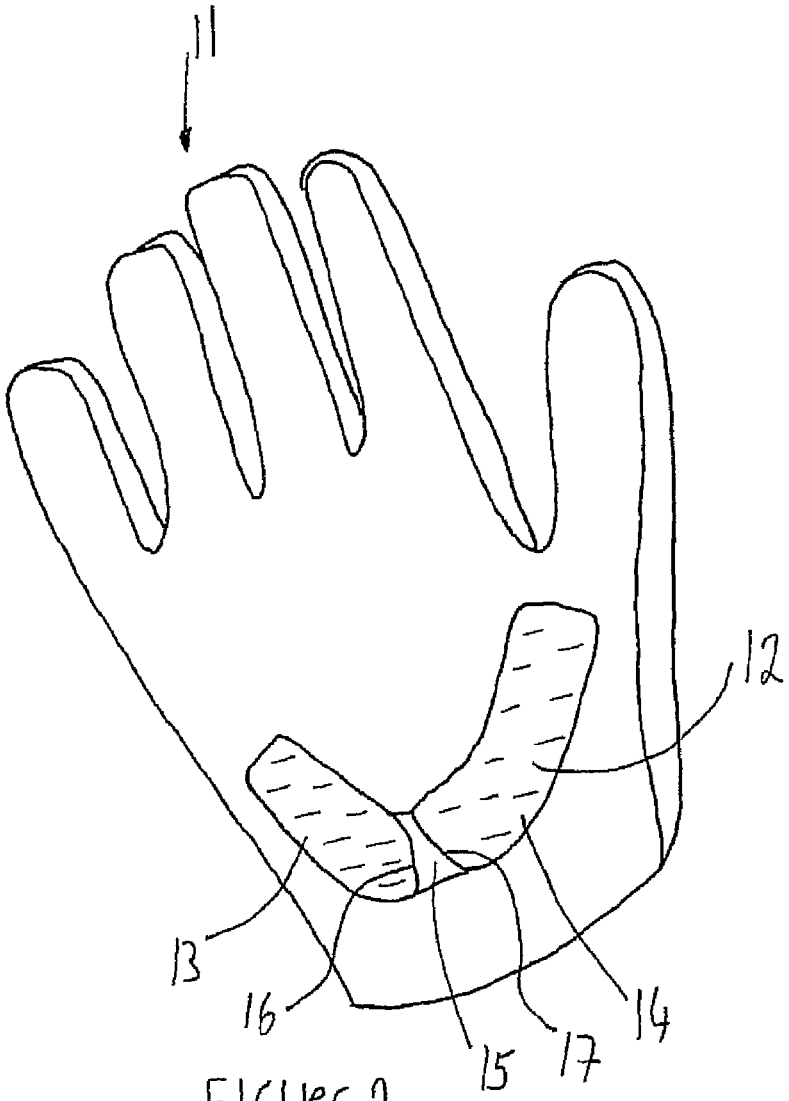
FIG. 2 represents in perspective view the underside of the right glove in accordance with a second embodiment.

FIG. 2 shows a glove 11 with an impact absorbing pad 12 which may be located beneath low friction pads (skids) 8 and 9 of glove 1. Pad 12 is constituted of two fluid containing chambers 13 and 14 which correspond in size to the low coefficient of friction pads (skids) 8 and 9 of glove 1. The fluid contained in chambers 13 and 14 may have a high viscosity by being for example a silicon gel. The walls of chambers 13 and 14 may be generally elastic so as to stretch, preferably without rupturing in most load conditions on impact. A further chamber 15 may be located between chambers 13 and 14 and designed to be empty of fluid during normal use. Walls 16 and 17 may be adapted to allow the passage of fluid from chambers 13 and 14 to chamber 15 on impact whilst sufficiently sealed during conventional use of the glove to effectively prevent such passage of fluid. This latest characteristic of the glove allows it to be particularly ergonomic whilst being sufficiently protective.

Figure 3:
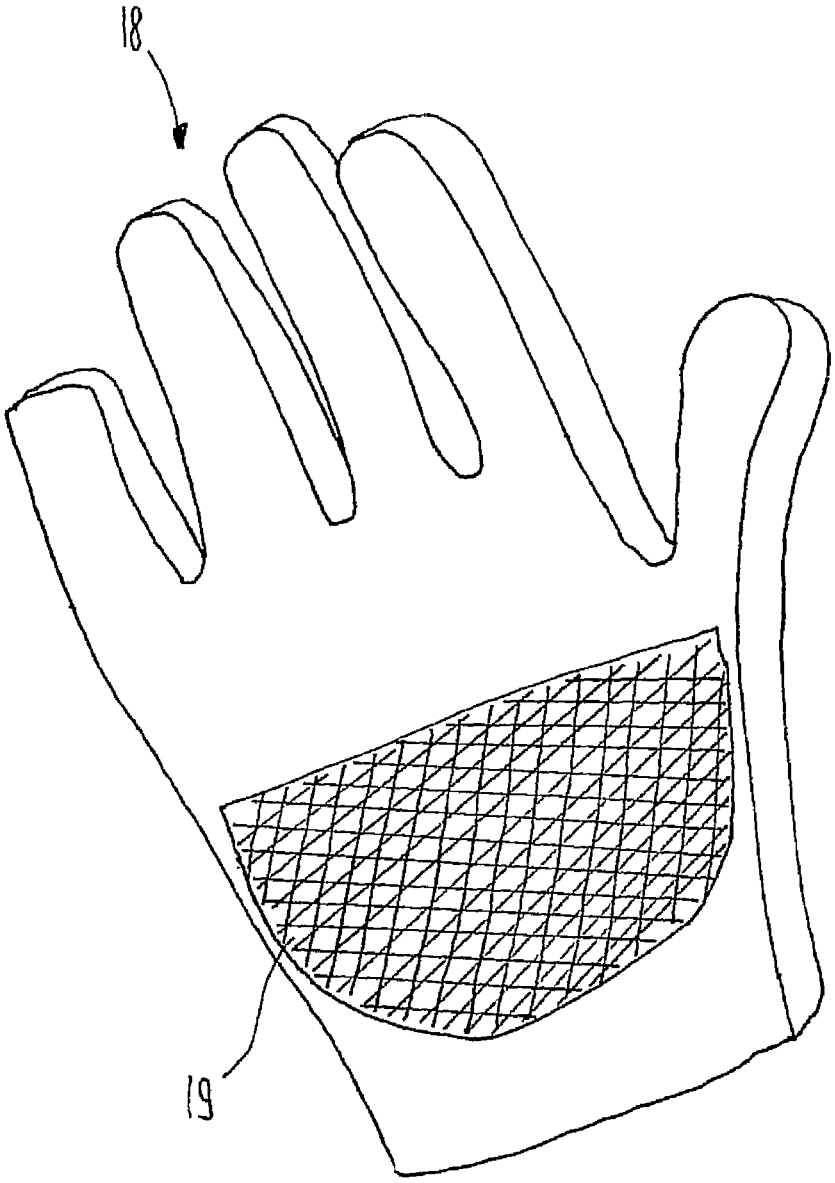
FIG. 3 shows a schematic perspective view of the underside of the right glove according to a third embodiment.

FIG. 3 presents glove 18 with a single low friction pad covering the carpal region and the lower portion of the metacarpal region of the user's hand when inserted in the glove. Pad 19 incorporates an array of fibres crossing each other to form a web like structure. The fibres protrude from the glove's surface in a preferred embodiment.

Pad 19 may be integral to the glove or may be constructed so as to be detachable from the glove should appropriate releasable attachable means be provided between the pad and the main body of the glove. These releasable attachment means may be selected by the person skilled in the art from known alternatives.

Figure 4:
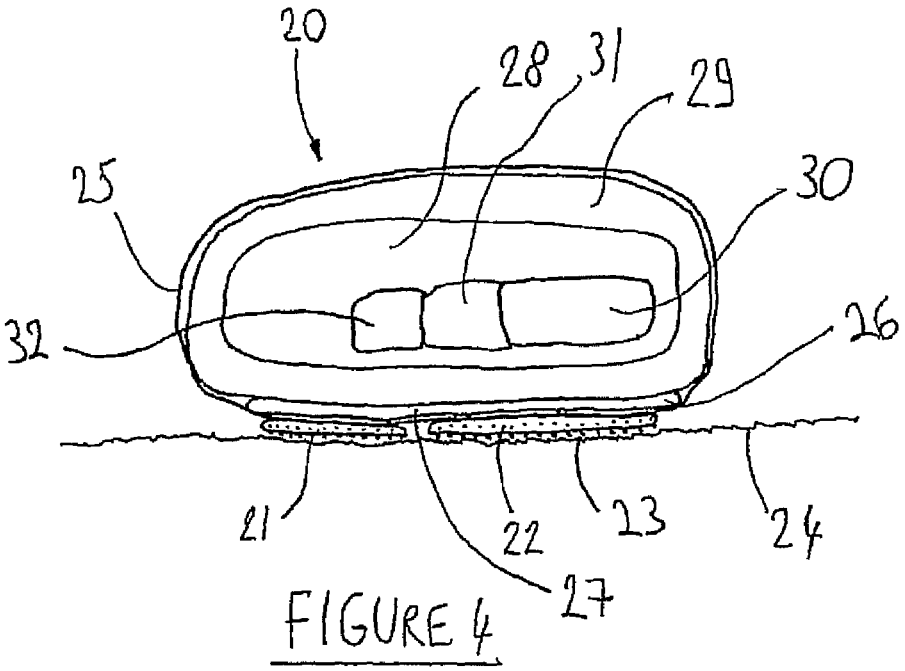
FIG. 4 represents a cross-sectional view across the low friction areas of the glove.

FIG. 4 presents a cross-section 20 of a glove similar to the gloves presented in FIG. 1 and FIG. 2, the section line following essentially a line through low friction pads (protruding skids) located over an absorption pad. There are provided two low friction pads 21 and 22 (skids 21 and 22) from which fibrous elements such as that referenced 23 project and are designed to achieve a low coefficient of friction on a typical road surface schematically illustrated and referenced 24. A waterproof layer 25 which may be selected to be of a breathable type by the person skilled in the art, wraps around the glove. Above friction pads 21 and 22, there is provided an absorption pad 26 within layer 25. Absorption pad 26 may incorporate a single chamber 27 or alternatively incorporate a number of chambers identical to that presented with reference to FIG. 2 and in which the wrist crease gap may be filled by fluid following the impact on the road surface.

Further towards the hand receiving chamber 28 of the glove, there is provided a thermal layer 29 of standard kind.

FIG. 4 also shows schematically within the glove the position of the scaphoid bone 30 as well as the lunate bone 31 and the lower region of a further wrist member 32.

Figure 5:
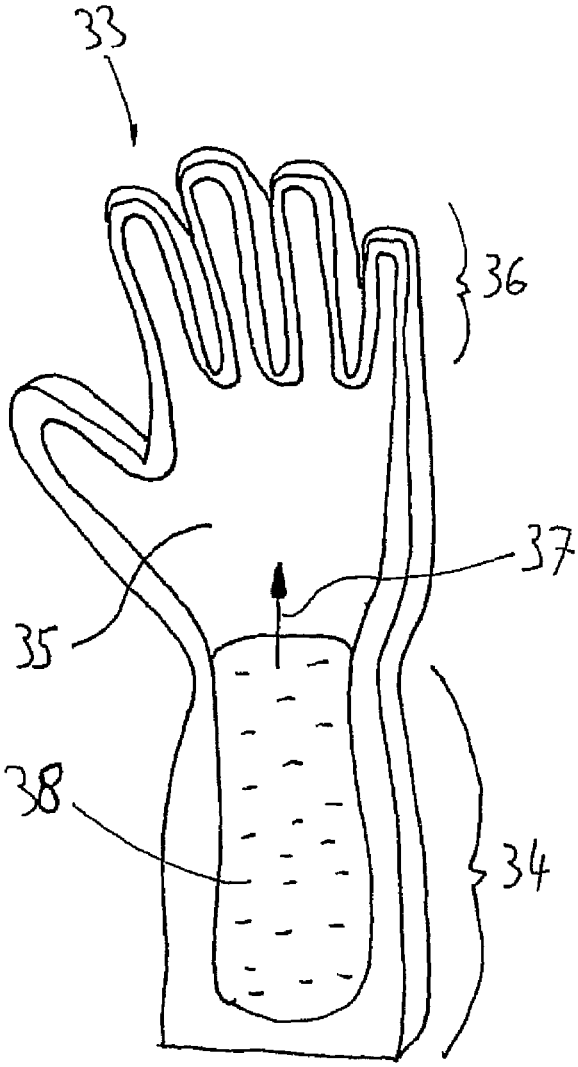
FIG. 5 shows the underside of a left glove in perspective view in accordance with a fourth embodiment of the present invention.

FIG. 5 represents a glove 33 with a single chamber 35 stretching from the glove's forearm region 34 up to the tips of the finger regions 36 of the glove. The walls of chamber 35 and the properties of the fluid 38 combine so that when the user holds onto the handle bars of the motorcycle the fluid contained within the chamber 35 migrates under the gripping action towards the forearm region 34. When the grip is released from the handle bars such as when outstretching the arms during a fall the fluid tends to flow into the wrist and palm region of the glove as shown by arrow 37 so as to absorb at least in part the force of the impact.

Furthermore when low friction pads or skids are provided over the palm or wrist of the user the force of impact will be reduced and will tend to be diverted towards the forearm which may also be protected by the lower region of chamber 35.

Figure 6:
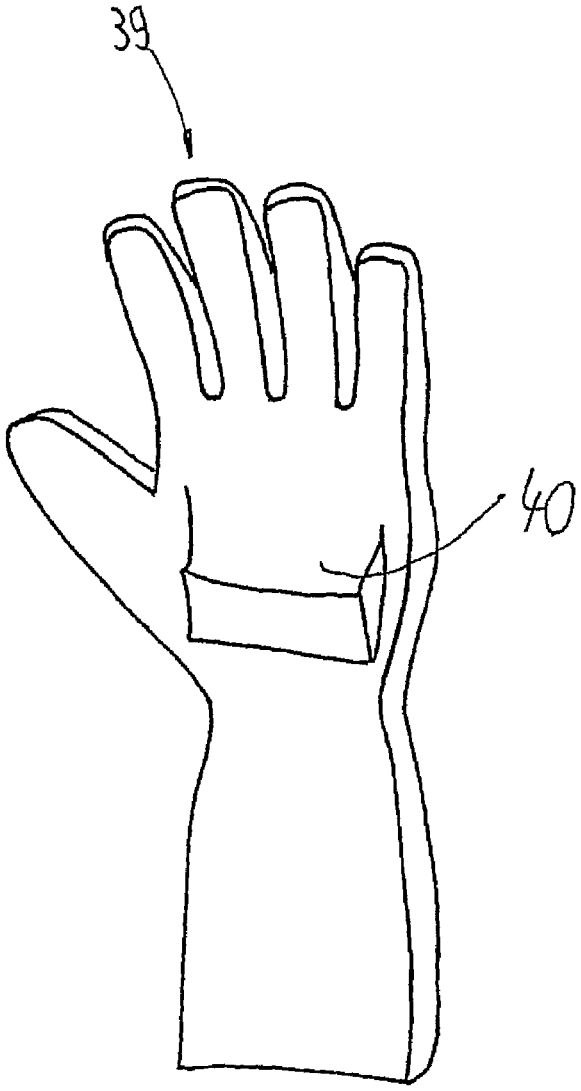
FIG. 6 shows the underside of a left glove in perspective view in accordance with a fifth embodiment.

FIG. 6 illustrates a further embodiment of the invention where a glove 39 incorporates a single chamber 40 protruding from the glove and of general triangular shape when viewed in cross-section. This configuration is particularly advantageous as it enhances the area over which the impact forces are spread and therefore will reduce the pressure exerted on a given bone. The protruding chamber may incorporate an outer low friction pad or skid. The low friction material in a preferred embodiment may be provided primarily on the tip of the chamber.

Figure 7:
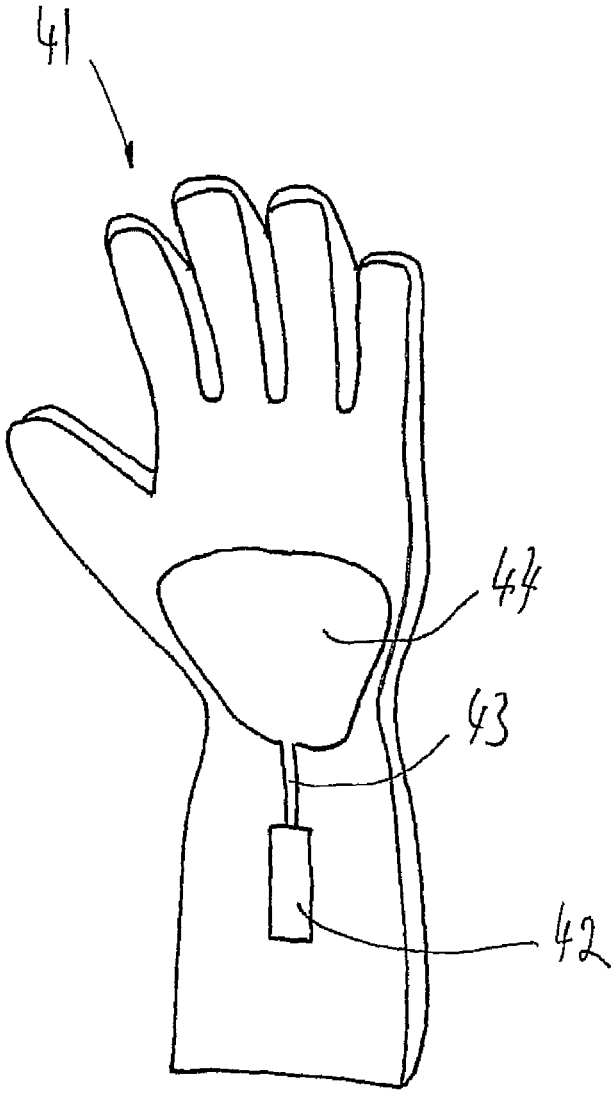
FIG. 7 represents a schematic perspective view of the underside of a left glove in accordance with a sixth embodiment.

FIG. 7 presents a glove 41 incorporating in the forearm region a chamber 42 capable of containing a pressurised fluid. The fluid of chamber 42 may be released into channel 43 and into impact absorbing section 44 on impact, as appropriate control means (not illustrated in the figure) instruct the opening of chamber 42.

Chamber 42 may be provided with an inlet valve (not illustrated in the figure) through which air or any other appropriate fluid selected by the person skilled in the art may be pumped into the chamber by the user through conventional means and retained therein. This latest feature would render possible the chamber's properties to be individually set by the wearer of the glove. The impact absorbing section may be covered by skids or low friction pads as described with reference to the embodiments of the invention.

The impact absorbing portion of the glove of any appropriate previously described embodiment may advantageously incorporate a portion of one or more chambers occupied by a first fluid operating in conjunction with a second portion of one or more chambers occupied by a second fluid, the second fluid being selected so that during impact when the first fluid is caused to displace in conjunction with the second fluid, the second fluid compresses so that when the impact force ceases to be applied the second fluid tends to return the first fluid to its position before impact. This may be achieved for example by having the second fluid be air whilst the first fluid is relatively less compressible such as a gel.

Figure 8:
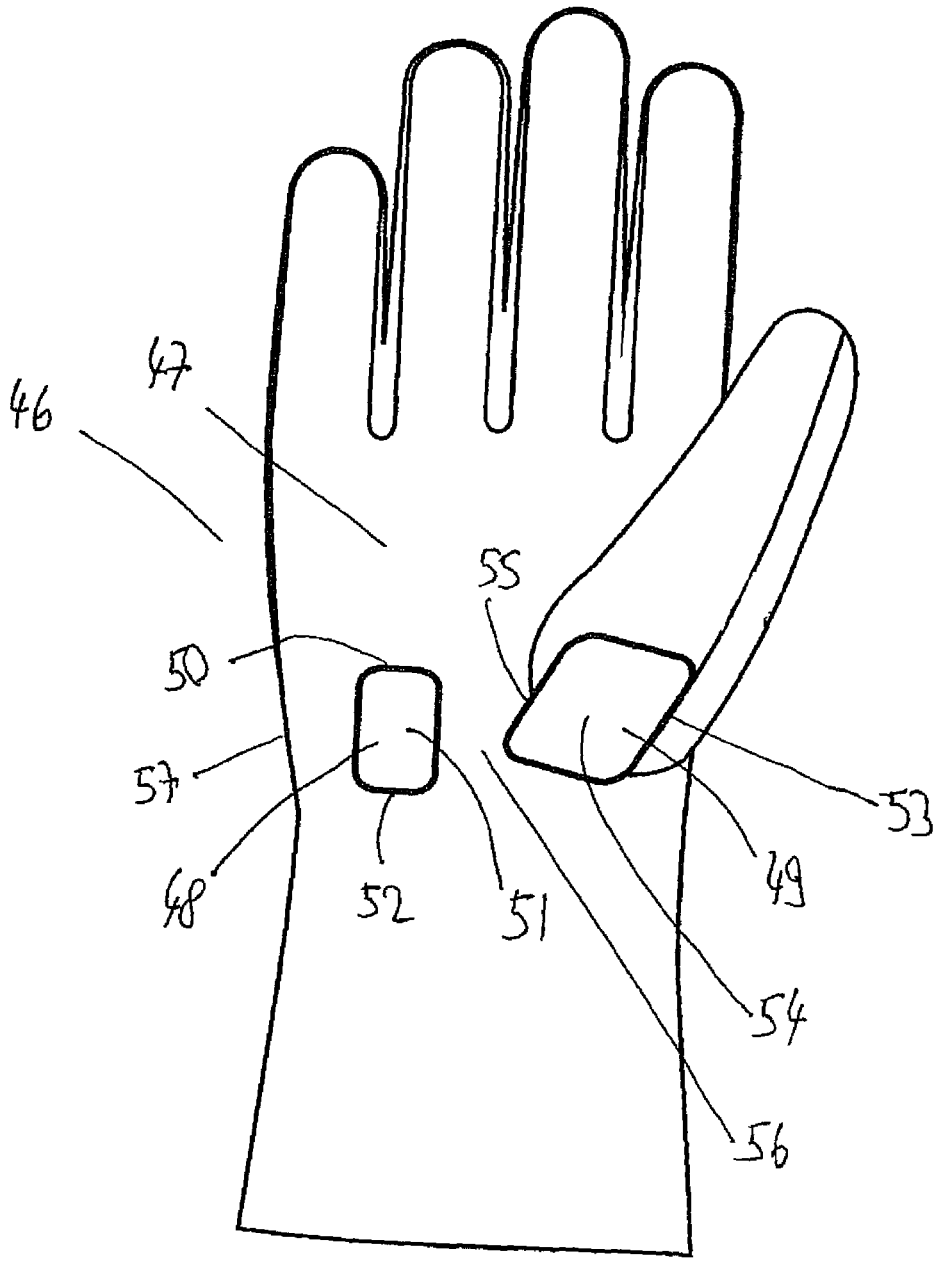
FIG. 8 shows a plan view of a right glove in accordance with a seventh embodiment.

FIG. 8 shows a glove 46 with a palm region 47. At a lower portion of the palm region 47, there are provided two low friction pads 48 and 49 which are also referred to as skids 48 and 49. Skid 49 protrudes from the surface of palm region 47 so that on impact on the road during a motor cycling fall, the outstretched hand of a wearer engages the ground with the skids so that the wearer tends to skid on the surface. Skid 48 likewise protrudes from the surface of palm region 47. Skids 48 and 49 are for example of rigid plastics material in order to facilitate sliding. Skid 48 is in effect a palm slider whilst skid 49 is a thumb slider.

Skid 48 is bowed in order to follow the contour of the wearer's hand. Skid 48 bows outwards. The bow increases from side 50 to a central portion 51. Similarly, the bow increases from side 52 to central region 51. Skid 49 is also outwardly bowed from side 53 to central region 54 and from side 55 to central region 54.

Skid 48 and skid 49 are separated by a gap 56 which is located in the wrist crease region. This region is of flexible material to allow a wearer to freely move his/her thumb without feeling any restriction from the presence of relatively rigid skids 48 and 49.

Skids 48 and 49 are secured tightly to the surface of the arm region. They may be secured through stitching and/or adhesion.

The location of skids 48 and 49 maximises the protection level achieved. In this regard, skid 48 is located to one side of the wrist crease region 56 whilst skid 49 is located on the other side of the wrist crease region.

Skid 49 follows the contour of the palm region located at the base of the thumb of the wearer. Skid 49 may be located over the lower portion of the metacarpal of the thumb. Alternatively, it may be located in the general scaphoid region. Alternatively, it may be located over the general trapezium region.

Skid 48 is located between the side 57 of the glove and the wrist crease region 56. It is designed to follow the contour of a lower portion of the palm region in that area. It may be located partially over the fifth metacarpal. Alternatively, it may be located in the general hamate region. Alternatively, it may be located in the general triquetrum region. Alternatively, it may cover a combination of these areas.

The embodiments of FIGS. 9 to 16 may have similar properties to those described with reference to the embodiment of FIG. 8. In order to avoid unnecessary repetition, these figures will be described in terms of differences when compared to the embodiment of FIG. 8.

Figure 9:
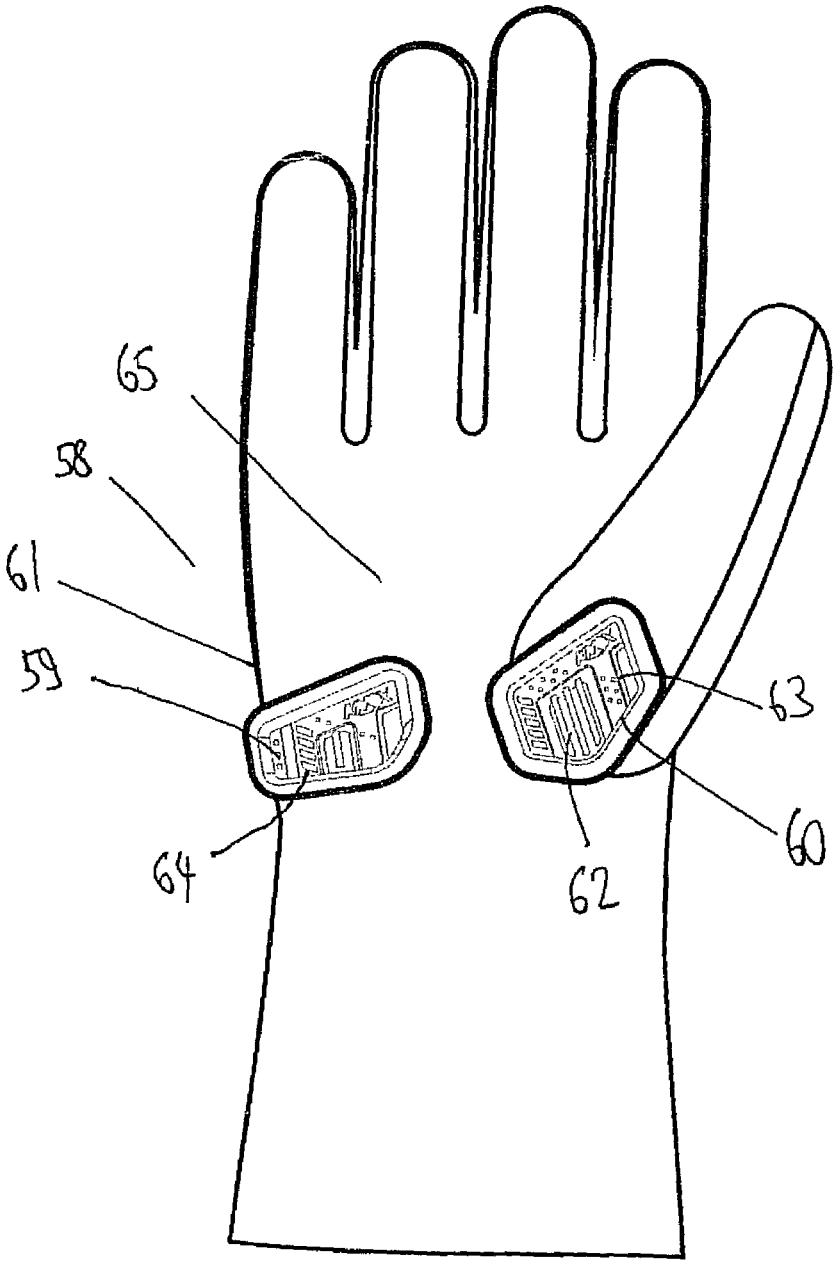
FIG. 9 represents a plan view of a right glove in accordance with an eighth embodiment.

FIG. 9 shows a glove 58 with a first and second skid generally referenced 59 and 60. Skid 59 extends beyond the side 61. Both skid 59 and skid 60 incorporate a number of ribs such as rib 62 to further facilitate sliding particularly on a rough surface such as tarmac. A plurality of holes 63 are provided. Furthermore, a plurality of troughs 64 are also provided. As in the previous embodiment skids 59 and 60 stand out proud from the palm region surface 65. A portion of the skid is located underneath the palm region surface in order to allow the skids to be secured in place.

Figure 10:
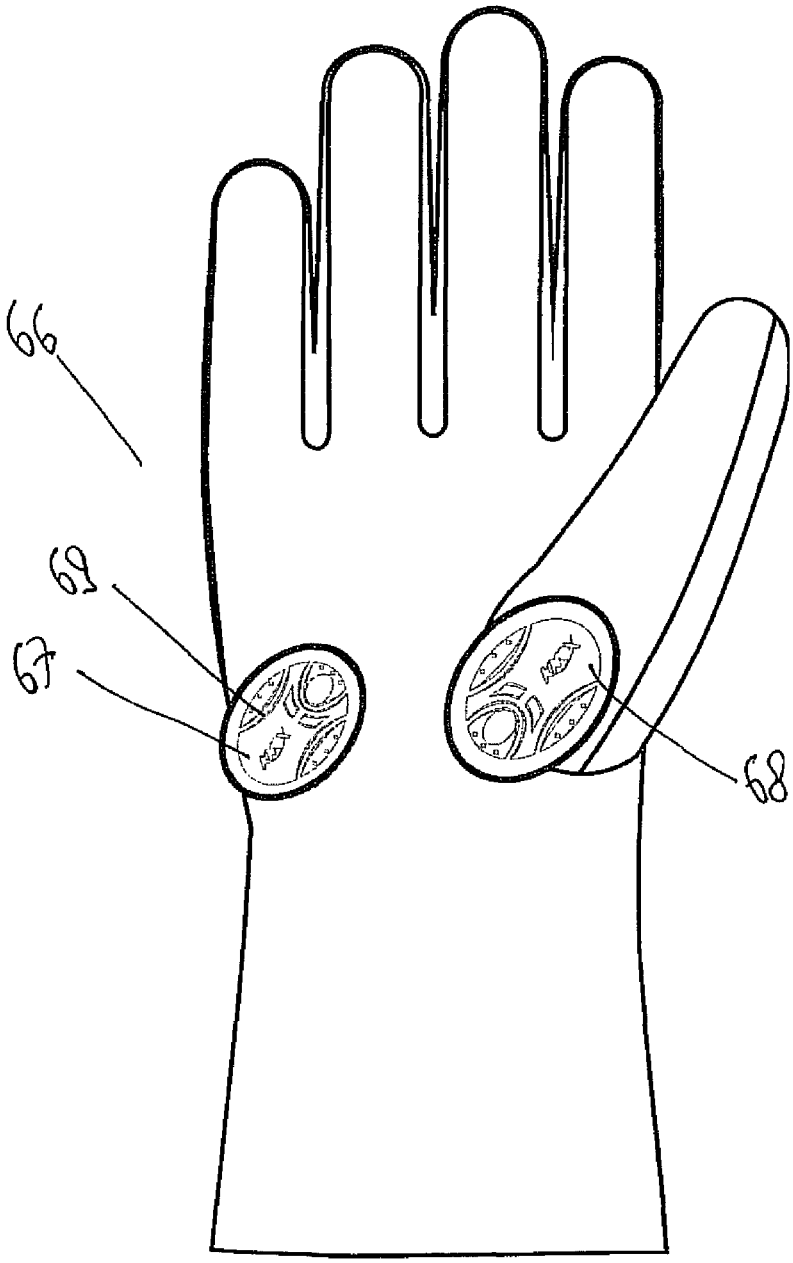
FIG. 10 shows a plan view of a right glove in accordance with a ninth embodiment.

FIG. 10 shows a glove 66 with a skid 67 and a skid 68. The skids protrude from the surface and are generally convex. A number of arcs such as arc 69 provide troughs for improved sliding. The oval skids are generally oriented in a diagonal direction.

Figure 11:
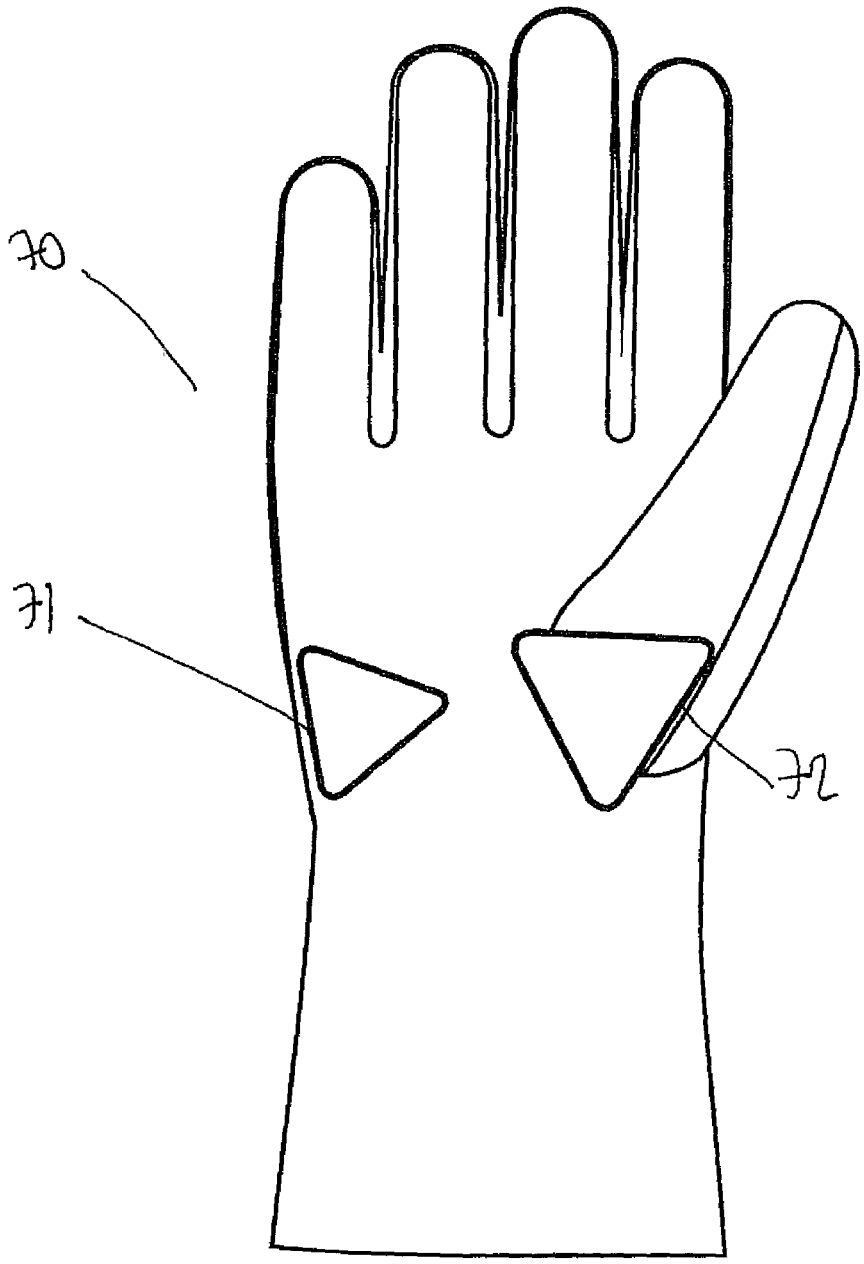
FIG. 11 shows a plan view of a right glove in accordance with a tenth embodiment.

FIG. 11 shows a glove 70 with a skid 71 and a skid 72. Both of the skids are of triangular shape.

Figure 12:
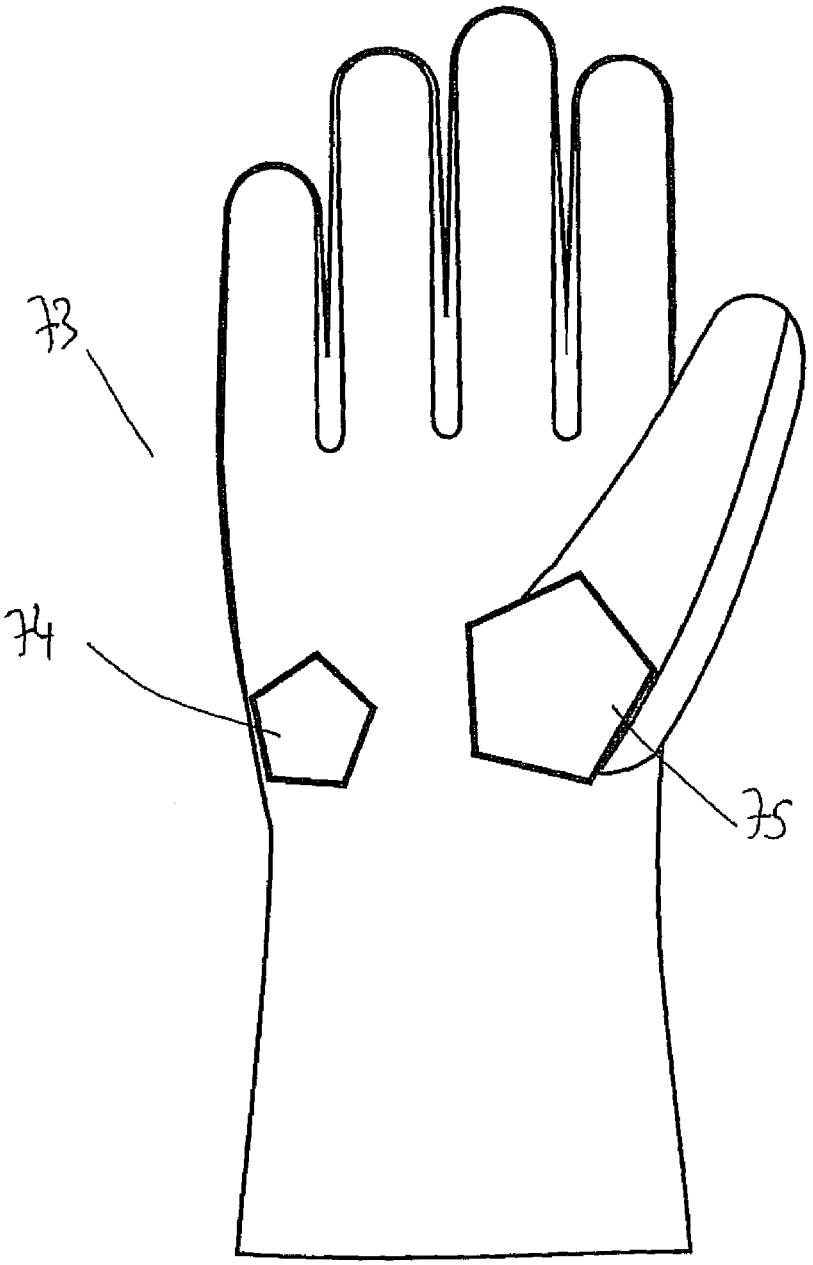
FIG. 12 shows a plan view of a right glove in accordance with an eleventh embodiment.

FIG. 12 shows a glove 73 with pentagonal skids 74 and 75.

Figure 13:
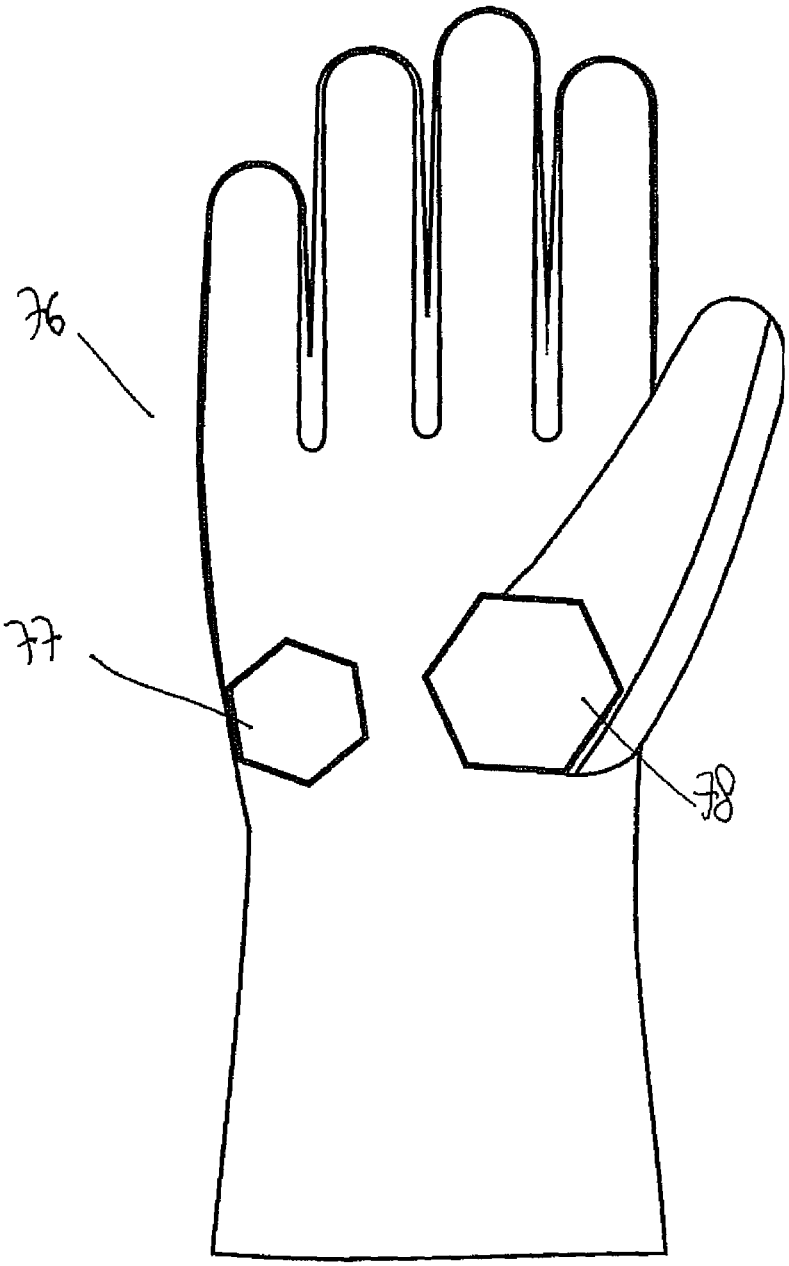
FIG. 13 shows a plan view of a right glove in accordance with a twelfth embodiment.

FIG. 13 shows a glove 76 with hexagonal skids 77 and 78.

Figure 14:
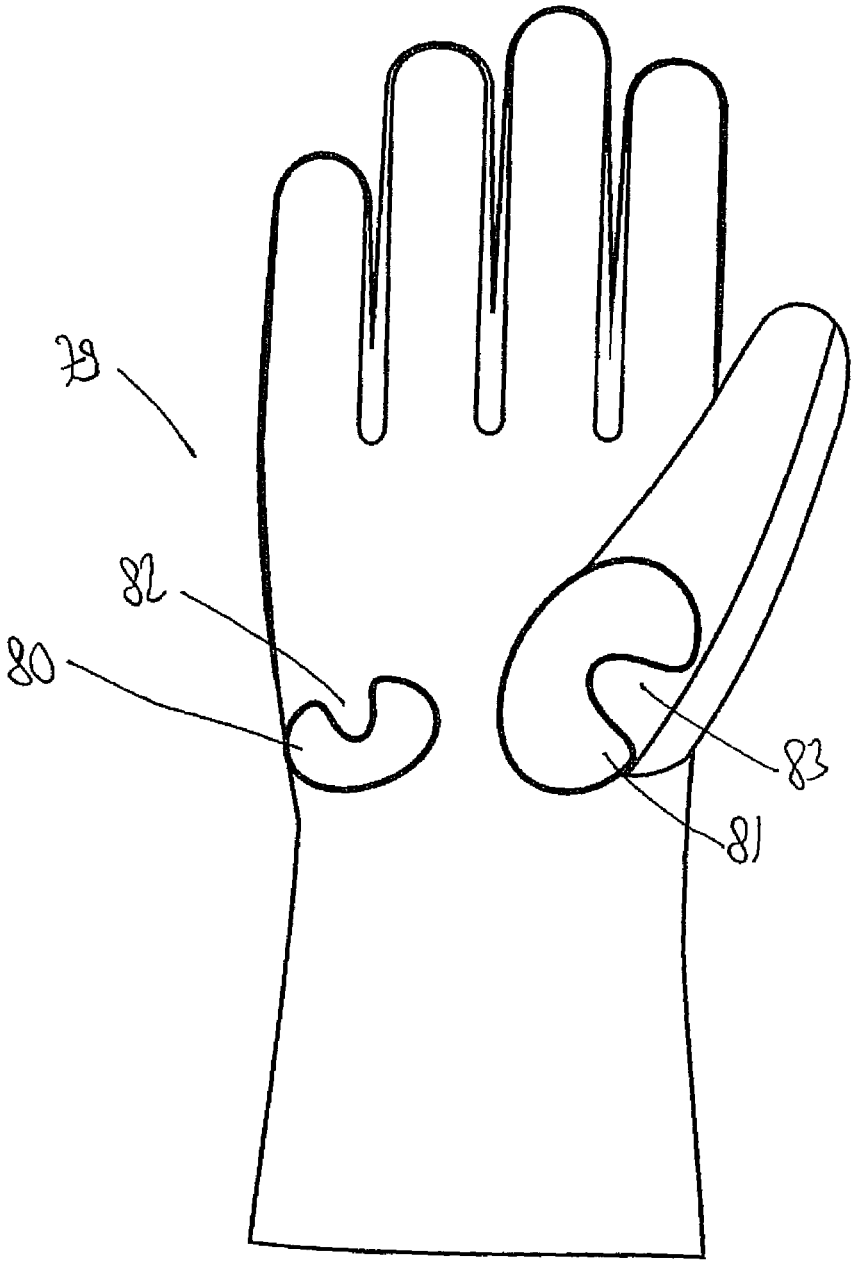
FIG. 14 shows a plan view of a right glove in accordance with a thirteenth embodiment.

FIG. 14 shows a glove 79 with c-shaped skids 80 and 81. Skid 80 has a side cut out 82 whilst skid 81 has a side cut out 83.

Figure 15:
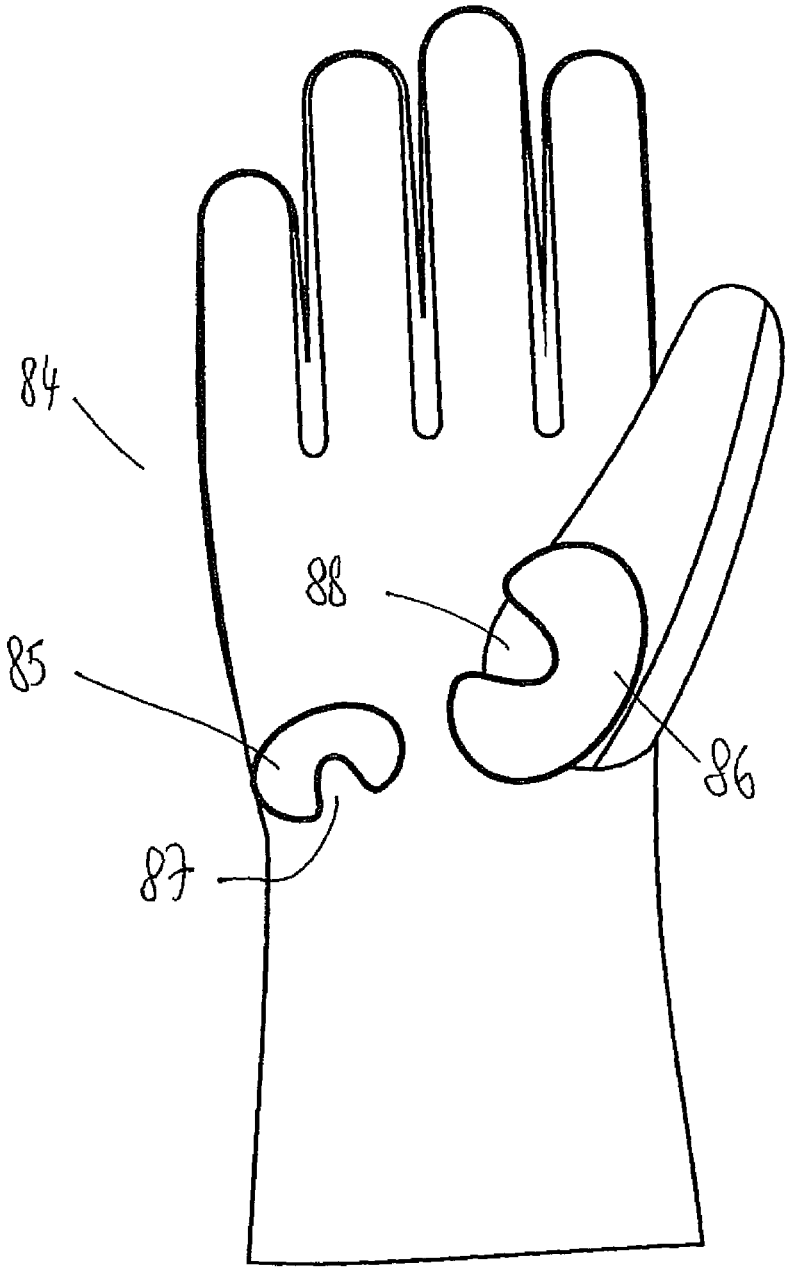
FIG. 15 shows a plan view of a right glove in accordance with a fourteenth embodiment.

FIG. 15 shows a glove 84 with skids 85 and 86. Skid 85 incorporates a lower cut out 7 whilst skid 86 incorporates a side cut out 88.

Figure 16:
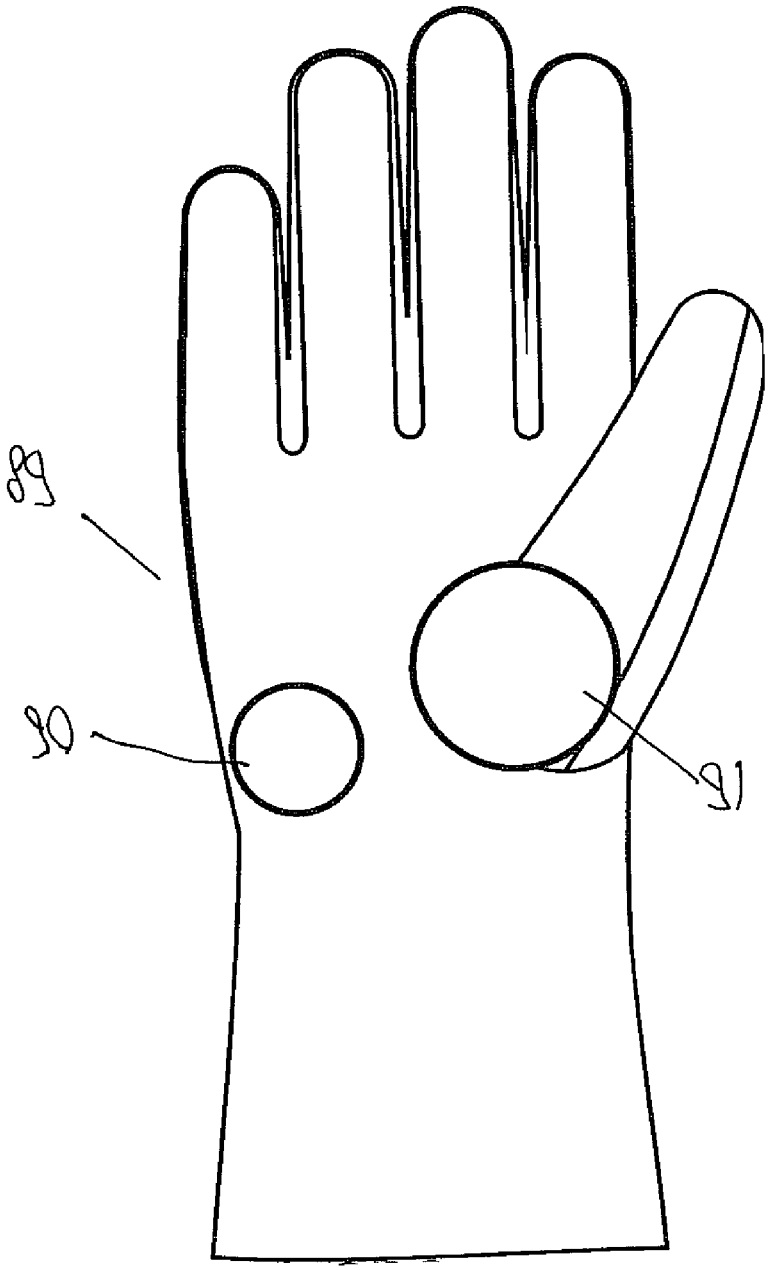
FIG. 16 shows a plan view of a right glove in accordance with a fifteenth embodiment.

FIG. 16 shows a glove 89 with skids 90 and 91 which are circular in shape Skids 90 and 91 may also be convex.

In the previous figures, skids located above a base portion of the thumb are generally larger than the skids located between the wrist crease region and the side region. At least the underneath of the skids are bowed or otherwise shaped in order to follow the contour of the wearer's hand.

In a further embodiment, it is envisaged that the outermost surface of the skid is substantially flat whilst the innermost surface of the skid is curved to follow the contour of the wearer's hand.

The invention claimed is:

1. A glove for use on a motorcycle, said glove comprising a front and a back, the front further comprising:

a palm region, said palm region comprising an internal surface proximate a hand during use and an external surface opposite the internal surface;

a finger region;

a thumb region;

separately displaceable finger and thumb covers which fully enclose the user's fingers; and a wrist crease region located above a wrist crease of a hand in use;

said glove further comprising a side region; said side region being located between said front and back of said glove at the opposite side of the glove to said thumb region;

wherein said palm region comprises an upper portion with an external surface of leather and a lower portion with a first skid tightly secured through one of stitching and adhesion to said external surface and protruding from said external surface and being provided only in a portion of said palm region between said wrist crease region and said thumb region; said skid being of a rigid material; whereby on impact on a road surface the wearer slides on the surface as said skids engage the road surface; wherein region of flexible material is present in the wrist crease region of the glove such that the wearer can freely move his thumb without feeling any restriction from the skid; and wherein said glove further comprises an impact absorbing chamber located beneath said skid.

2. A glove according to claim 1, wherein said skid is metallic.

3. A glove according to claim 1, wherein said skid is of plastics material.

4. A glove according to claim 1, wherein said skid is located in a portion of said palm region corresponding to a scaphoid of a hand during use.

5. A glove according to claim 1, further comprising a second skid protruding from said external surface and being provided only in a portion of said palm region between said wrist crease region and said side region; and a gap between said first and second skid.

6. A glove according to claim 5, wherein both said first skid and said second skid are outwardly bowed.

7. A glove according to claim 1, wherein said skid incorporates projections.

8. A glove according to claim 7, wherein said projections are fibrous elements.

9. A glove according to claim 1, wherein said first skid is C-shaped.

10. A glove according to claim 1, further comprising a wrist portion of said palm region and wherein the impact absorbing chamber is a fluid fillable chamber located over at least a portion of said wrist portion.

11. A glove according to claim 10, further comprising at least one further chamber containing fluid, said further chamber being situated adjacent to the fluid fillable chamber; wherein said chamber in said wrist portion of the glove is primarily empty whilst riding a motorbike and on impact fluid flows from said adjacent chamber into said chamber in said wrist portion.

12. A glove according to claim 1, further comprising a forearm region; a first chamber portion extending into said forearm region of said glove; a second chamber portion extending into said palm region of said glove; and a fluid in at least one of said chambers; whereby when pressure is exerted on said second chamber portion when holding the handle bars of a motorcycle said fluid is forced primarily into said first chamber portion and upon outstretching the hand, said fluid circulates from said first chamber portion to said second chamber portion.

13. A glove according to claim 1, wherein said skid incorporates a polyethylene layer.

14. A glove according to claim 1, wherein an impact absorbing portion is located beneath said skid.

15. A glove according to claim 1, wherein said skid is outwardly bowed.

* * * * *